US010686272B2

(12) United States Patent
Kufner et al.

(10) Patent No.: US 10,686,272 B2
(45) Date of Patent: Jun. 16, 2020

(54) CONTACT ELEMENT

(71) Applicant: STAUBLI ELECTRICAL CONNECTORS AG, Allschwil (CH)

(72) Inventors: Tom Kufner, Riehen (CH); Philipp Alexander Strehler, Basel (CH); Fabian Hilti, Ziefen (CH); Lucas Wirz, Basel (CH)

(73) Assignee: STAUBLI ELECTRICAL CONNECTORS AG, Allschwil (CH)

( * ) Notice: Subject to any disclaimer, the term of this patent is extended or adjusted under 35 U.S.C. 154(b) by 0 days.

(21) Appl. No.: 16/303,179

(22) PCT Filed: May 19, 2017

(86) PCT No.: PCT/EP2017/062067
§ 371 (c)(1),
(2) Date: Nov. 20, 2018

(87) PCT Pub. No.: WO2017/202709
PCT Pub. Date: Nov. 30, 2017

(65) Prior Publication Data

US 2019/0305458 A1 Oct. 3, 2019

(30) Foreign Application Priority Data

May 25, 2016 (EP) ..... 16171340
May 25, 2016 (EP) ..... 16171341
May 25, 2016 (EP) ..... 16171346

(51) Int. Cl.
*H01R 13/24* (2006.01)
*H01R 4/48* (2006.01)
*H01R 43/00* (2006.01)

(52) U.S. Cl.
CPC ..... *H01R 13/24* (2013.01); *H01R 4/4881* (2013.01); *H01R 13/2457* (2013.01); *H01R 13/2492* (2013.01); *H01R 43/007* (2013.01)

(58) Field of Classification Search
CPC ..... H01R 13/17; H01R 13/15; H01R 13/187; H01R 13/24; H01R 13/2457; H01R 13/2492; H01R 4/4881; H01R 43/007
(Continued)

(56) References Cited

U.S. PATENT DOCUMENTS 3,003,135 A * 10/1961 Purinton ..... H01R 13/642 439/843
4,456,325 A 6/1984 Benz
(Continued)

FOREIGN PATENT DOCUMENTS

CN 103875129 A 6/2014
CN 104600456 A 5/2015
(Continued)

OTHER PUBLICATIONS

Multilam Contact Band Technology for Tool Changers, posted at Robotics.org, posted on Oct. 24, 2012, site visited 11/0 (Year: 2012), 1 page total.
(Continued)

*Primary Examiner* — Gary F Paumen
(74) *Attorney, Agent, or Firm* — Sughrue Mion, PLLC

(57) ABSTRACT

A contact element (1) for establishing electric contact between two contact pieces comprises a support grip (2) extending in a longitudinal direction (L) as well as a plurality of contact parts (5,5*a*, 5*b*), each of which has a first contact section (6) for contacting one of the two contact pieces (K1, K2), a second contact section (7) for contacting the other one of the two contact pieces (K2, K1), and a fastening section (8) for securing the contact part (5, 5*a*, 5*b*)
(Continued)

to the support strip (2) at a fastening point (3). Each contact part (5, 5*a*, 5*b*) comprises at least one plastically deformable connection element (50) for securing the contact part (5, 5*a* 5*b*) to the support strip (2). The at least one connection element (50) forms an integral part of the contact part (5, 5*a*, 5*b*).

19 Claims, 10 Drawing Sheets

(58) Field of Classification Search
USPC ..... 439/827, 843
See application file for complete search history.

(56) References Cited

U.S. PATENT DOCUMENTS

| | | | | |
|---|---|---|---|---|
| 5,261,840 | A | 11/1993 | Benz | |
| D463,338 | S | 9/2002 | Ioka et al. | |
| 6,547,607 | B2 * | 4/2003 | Moll | H01R 13/187 439/816 |
| D476,623 | S | 7/2003 | Oohashi et al. | |
| 7,078,614 | B1 | 7/2006 | Haaster | |
| 7,357,671 | B2 * | 4/2008 | Wild | H01R 9/0521 439/583 |
| 7,697,669 | B2 * | 4/2010 | Stepanian | G06F 1/1626 370/352 |
| 8,057,269 | B2 * | 11/2011 | Ledermann | H01R 13/187 439/827 |
| 8,821,170 | B1 | 9/2014 | Thein et al. | |
| D753,066 | S | 4/2016 | Sturgess et al. | |
| 2001/0019923 | A1 | 9/2001 | Moll et al. | |
| 2005/0095912 | A1 | 5/2005 | Yang | |
| 2010/0227507 | A1 | 9/2010 | Cheng et al. | |
| 2010/0330821 | A1 | 12/2010 | Takeuchi et al. | |
| 2012/0088383 | A1 | 4/2012 | Qu et al. | |
| 2012/0115340 | A1 | 5/2012 | Yamamoto | |
| 2016/0226181 | A1 | 8/2016 | Sturgess et al. | |
| 2017/0225225 | A1 | 8/2017 | Sarkisian et al. | |

FOREIGN PATENT DOCUMENTS

| | | | |
|---|---|---|---|
| DE | 30 14 118 | B1 | 2/1981 |
| EP | 0 716 474 | A1 | 6/1996 |
| EP | 1 119 077 | A1 | 7/2001 |
| EP | 2 693 573 | A2 | 2/2014 |
| EP | 2 115 820 | B1 | 9/2015 |
| GB | 2 398 680 | A | 8/2004 |
| WO | 2008/092284 | A1 | 8/2008 |

OTHER PUBLICATIONS

The New Multilam ML-I, posted atEc.staubli.com, posted on Apr. 16, 2015, site visited Nov. 9, 2017. online, Avail (Year: 2015), 1 page total.
New high-performance Multilam LA-CUDD, posted at Ec.staubli.com, posted on Oct. 25, 2012, site visited 11/ (Year: 2012), 1 page total.
Communication dated Oct. 25, 2016, from the European Patent Office in counterpart European Application No. 16171341.7.
Communication dated Oct. 25, 2016, from the European Patent Office in counterpart European Application No. 16171340.9.
Communication dated Oct. 25, 2016, from the European Patent Office in counterpart European Application No. 16171346.6.
International Search Report of PCT/EP2017/062065 dated Jul. 13, 2017.
International Search Report of PCT/EP2017/062066 dated Jul. 14, 2017.
Communication dated Aug. 18, 2019, from the State Intellectual Property Office of the P.R.C in application No. 2017800308014.
International Search Report for PCT/EP2017/062067 dated Jul. 13, 2017 [PCT/ISA/210].

* cited by examiner

CONTACT ELEMENT

CROSS REFERENCE TO RELATED APPLICATIONS

This application is a National Stage of International Application No. PCT/EP2017/062067, filed on May 19, 2017, which claims priority from European Patent Application No. 16171340.9, filed on May 25, 2016, European Patent Application No. 16171346.6, filed on May 25, 2016, and European Patent Application No. 16171341.7, filed on May 25, 2016.

TECHNICAL FIELD

The present invention relates to a contact element for establishing electrical contact between two contact pieces according to the preamble of claim 1.

PRIOR ART

The prior art has disclosed contact elements, which can also be called contact lamellae. For example, EP 0 716 474 describes a contact element that comprises a unipartite contact strip that extends along a longitudinal direction and by way of which two opposite contact faces can be electrically connected. The length of the contact strip can be slightly deformed, so that said contact strip can be installed in a simple manner.

Although the deformation of the contact strip during installation is highly advantageous, the contact lamella according to EP 0 716 474 exhibits a few disadvantages.

Firstly, the scalability in respect of the electric currents to be transmitted is highly limited. An increase in the current is typically also accompanied by an increase in the cross section of the contact element. Scaling of this kind is not readily possible because otherwise advantageous properties are lost. For example, the contact element becomes stiffer in the event of an increase.

EP 2 115 820 has disclosed a contact element in which the contact parts that establish the electrical contact are fastened to a carrier strip. Fastening of the contact parts to the carrier strip is comparatively effortful.

SUMMARY OF THE INVENTION

Proceeding from this prior art, the object of the invention is to specify a contact element that overcomes the disadvantages of the prior art. A particular aim is to be able to produce the contact element in a more efficient manner. Furthermore, a preferred object is that the degree of freedom in respect of dimensioning should be increased.

This object is achieved by a contact element as claimed in claim 1. Accordingly, a contact element for establishing electrical contact between two contact pieces comprises a carrier strip that extends in a longitudinal direction and a plurality of contact parts each having at least one first contact section for making contact with one of the two contact pieces, at least one second contact section for making contact with the other of the two contact pieces, and also having at least one fastening section for fastening the contact part to the carrier strip at a fastening spot. Each contact part comprises at least one plastically deformable connecting element for fastening the contact part to the carrier strip.

The arrangement of the plastically deformable connecting element provides the advantage that the contact part can be connected to the carrier strip in a simple manner. As a result, the contact element can be produced in a simple manner. Furthermore, the separate configuration between the carrier strip and the contact part provides the advantage that the contact part can be dimensioned independently of the carrier strip. In particular, the contact part can be formed with a high material content, which has the advantage that higher currents can be transmitted.

In a first embodiment, the at least one connecting element is an integral constituent part of the contact part or of the fastening section. Furthermore, the at least one connecting element has a shaft that protrudes away from the fastening section, which shaft is plastically deformed in a forming process in such a way that the shaft forms a mechanically fixed connection with the carrier strip.

The expression "integral constituent part" is intended to be understood to mean that the contact part and the connecting element resp. the shaft are formed in one piece. That is to say, the connecting element and the contact part form a one-piece structure. In other words, the connecting element is integrally formed with the contact part.

The one-piece design of the contact part provides the advantage that a single element, namely the contact part, has to be connected to the carrier strip during assembly. That is to say, the provision and handling of additional fastening elements is omitted.

In addition, the contact part itself can be efficiently produced in a simple manner and in large numbers by a forming method.

The at least one connecting element is preferably formed in one piece with the contact part in one piece by means of the fastening section.

In particular, the at least one connecting element is formed from the fastening section.

The at least one connecting element is particularly preferably pressed out of the fastening section by means of a stamping process or a press joining process. That is to say, the connecting element can be formed by material that already is present at the fastening section.

After the connecting element has been pressed out, the fastening section preferably has an indentation opposite the connecting element, wherein the volume of the indentation corresponds substantially to the volume of the connecting element that has been pressed out. The fastening section is therefore plastically deformed in the region of the connecting element in order to form the connecting element. The fastening section is preferably not formed with an increased material content in the region of the connecting element, as a result of which said indentation is produced by the plastic deformation.

In a second embodiment, which is claimed by claim 5, the at least one plastically deformable connecting element is arranged fixedly on the contact part before the plastic deformation and before the connection to the carrier strip. Furthermore, the at least one connecting element has a shaft that protrudes away from the fastening section, which shaft is plastically deformed in a forming process in such a way that the shaft forms a mechanically fixed connection with the carrier strip.

According to the second embodiment, the at least one plastic connecting element is fixedly arranged on the fastening section before the forming process, that is to say before the plastic deformation of the shaft. That is to say, the connecting element can be a separate element that is fixedly connected to the contact part by means of the fastening section before the connection to the carrier strip and before the riveting. That is to say, the connecting element and the contact part form a one-piece structure for assembly on the carrier strip, which has the advantages cited above in connection with the first embodiment.

According to the second embodiment, the at least one connecting element preferably protrudes by way of the shaft through an opening in the fastening section and is fixedly fastened to the fastening section, wherein the fastening is established in an interlocking manner and/or a force-fitting manner and/or a cohesive manner.

The expression "mechanically fixed" is intended to be understood in respect of all of the embodiments to mean that the contact part is fixedly connected, that is to say connected in a substantially non-detachable manner, to the carrier strip by means of the plastically deformed shaft. The mechanically fixed connection is preferably a force-fitting connection and/or an interlocking connection and/or a cohesive connection.

In all embodiments, the connecting element or the shaft is deformed substantially on that side of the carrier strip that is situated opposite the contact part, wherein the shaft extends substantially completely through the fastening opening. In the non-deformed state, the shaft protrudes away from said opposite side of the carrier strip and is then deformed toward the carrier strip.

Preferably, the shaft is pressed against the wall of the fastening opening by the forming process for the purpose of mechanical connection in all of the embodiments. The shaft is therefore plastically deformed during the forming process, as a result of which its diameter becomes larger. That is to say, the shaft is pressed against the wall of the fastening opening by way of its casing surface transverse to the shaft axis. Said force-fitting connection can be provided in this way.

As an alternative to this, for the purpose of mechanical connection, the connecting element, by way of its shaft, protrudes beyond the carrier strip before the plastic deformation and a head section is formed at the protruding end of the shaft by the forming process, the dimension of said head section transverse to the shaft axis being larger than the cross section of the fastening opening. Said interlocking connection can be provided in this way.

In a further alternative, for the purpose of mechanical connection, the shaft is pressed against the wall of the fastening opening by the forming process and a head section is formed at the protruding end of the shaft by the forming process, the dimension of said head section transverse to the shaft axis being larger than the cross section of the fastening opening. Said force-fitting connection and interlocking connection can be provided in this way.

In other words: The connecting elements extend away from a bottom side of the contact part, which faces the carrier strip, protrude through fastening openings in the carrier strip and are plastically deformed on that side of the carrier strip that is opposite the support of the contact part.

In all of the embodiments described herein, the shaft is preferably deformed over its entire cross section with respect to the protruding part. That is to say, the shaft is completely plastically compressed over its cross section by a tool. As an alternative to this, the shaft can also be selectively deformed at different subregions of its cross section. That is to say that, specifically in the case of relatively large cross sections, only subregions of the shaft can also be plastically deformed. For example, a tool can engage at different spots on the shaft end, so that not the entire shaft cross section is reshaped.

To assist plastic deformation, the connecting element can also further be welded or soldered.

Preferably, in all of the embodiments described herein, the shaft that protrudes away from the fastening section, has, in the undeformed state, a length that corresponds at least to the thickness of the carrier strip and/or that corresponds at most to the thickness, in particular to half the thickness, of the fastening section.

The thickness of the carrier strip is the dimension of the carrier strip in the direction of the extension of the shaft.

Preferably, in all of the embodiments described herein, there are precisely two connecting elements or more than two connecting elements for each contact part. As an alternative, there can also be a single connecting element.

The precisely two connecting elements or the more than two connecting elements are preferably spaced at a distance in relation to one another, wherein the distance is, in particular, formed in such a way that the connecting elements do not touch in the deformed state. That is to say that the connecting elements can be deformed independently of one another and primarily without negatively influencing one another.

Preferably, the connecting element, as seen from the fastening section, extends along a shaft axis in all of the embodiments described therein, wherein the dimension in a first transverse axis that is transverse to the shaft axis is larger than the dimension in a second transverse axis that is transverse to the shaft axis and to the first transverse axis. As an alternative, the dimension can also be the same. The connecting element is shaped in a non-round resp. not round manner. The advantage of this design is that the cross section of the connecting element can be optimized, in particular can be selected to be as large as possible.

In a particularly preferred development, the connecting element extends along a shaft axis as seen from the fastening section, wherein the dimension in a first transverse axis, which lies transverse to the shaft axis, is larger than the dimension in a second transverse axis, which lies transverse to the shaft axis and transverse to the first transverse axis, wherein the shaft is selectively deformed at different subregions of its cross section. In this context, the selective deformation provides the advantage that the deformation can be better controlled and, in particular, can be steered in mechanically favorable directions.

Preferably, the shaft is deformed at at least two subregions or exactly two subregions, which are situated opposite one another with respect to the second transverse axis.

The deformation is particularly preferably round or polygonal.

The first transverse axis preferably runs in a manner inclined at an angle in relation to the longitudinal direction of the carrier strip. However, the first transverse axis can also be at a right angle in relation to the longitudinal axis.

Preferably, the at least one connecting element in all of the embodiments described herein has a round cross section or an oval cross section or a polygonal cross section or an n-gonal cross section. The at least one connecting element particularly preferably has a cross section that complements an elongate hole. That is to say, the cross section is substantially in the shape of a rectangle, wherein two opposite side edges are formed in a rounded manner.

The shape of the fastening opening preferably corresponds to the shape of the connecting element. There can be a small degree of backlash with a range of at most 0.1 millimeters between the connecting element and the fastening opening.

Preferably, the connecting element preferably has a full cross section in all of the embodiments described herein.

That is to say, the shaft has a full cross section. However, the shaft may also be of hollow design.

The connecting element can also be called a rivet.

In one development, the carrier strip that extends in the longitudinal direction comprises a plurality of fastening spots, in the form of fastening lugs, which are spaced in relation to one another in the longitudinal direction, wherein the carrier strip is formed in such a way that, when a force is applied to the carrier strip, a relative displacement of the fastening lugs in relation to one another is possible in the longitudinal direction. The contact parts each comprise a first contact section for making contact with one of the two contact pieces, a second contact section for making contact with the other of the two contact pieces, and also a fastening section for fastening the contact part to a fastening lug.

Preferably, precisely one single contact part is provided for each fastening lug. The number of fastening lugs corresponds to the number of contact parts.

The contact parts are formed separately from the carrier strip and are fixedly connected to the carrier strip by means of the fastening section. The contact part is preferably connected to the carrier strip by way of the at least one connecting element.

The material of the carrier strip is preferably different from the material of the contact part. The material of the carrier strip preferably has good elastic deformation properties and the material of the contact part preferably exhibits good electrical conductivity.

The material of the carrier strip is preferably composed of metal, in particular steel, particularly preferably spring steel or stainless spring steel. The material of the contact part is preferably composed of copper or alloys of copper. The contact part is preferably provided with a coating that improves electrical contact. For example by a silver coating.

The carrier strip is preferably produced by a sheet-metal strip, which in particular is shaped by means of a stamping process or laser cutting. However, the sheet-metal strip can also be produced in some other way.

The second contact section of the contact part is preferably situated in relation to the carrier strip in such a way that the carrier strip and possibly the connecting element do not come into connection with the contact piece in the contact position. For example, the second contact section can be offset or bent away from the bottom side of the connecting section that is situated on the carrier strip. The second contact section can therefore be part of a raised portion with respect to the fastening section.

The cross section of the contact part in the region of the fastening section is preferably larger than the cross section of the contact part in the region of the first contact section. The cross section of the first contact section is therefore designed in a tapered manner with respect to the fastening section. As an alternative or in addition, the cross section of the contact part in the region of the fastening section is larger than the cross section of the contact part in the region of the second contact section. As an alternative, the cross section of the contact part in the region of the fastening section can be substantially equal to the cross section in the region of the second contact section.

The contact part can therefore be formed in a manner reduced in size in sections.

As a result, effective mounting of the fastening section on the fastening lug can be achieved with optimum utilization of material.

The contact part particularly preferably tapers from the fastening section toward the first contact section.

As explained above, the contact part is fastened to the fastening spot resp. to the fastening lug of the carrier strip by means of the fastening section. In this case, the fastening section can be formed differently in accordance with the first and the second embodiment.

A method for producing a contact element according to the first embodiment in line with the above description is characterized by the steps of a) providing the carrier strip;

b) providing the contact parts; and c) connecting the contact parts to the carrier strip, and d) plastically deforming the shaft of the at least one fastening element, wherein the step of providing the contact parts comprises forming the fastening element from the contact part.

A method for producing a contact element according to the second embodiment in line with the above description is characterized by the steps of a) providing the carrier strip;

b) providing the contact parts; and c) connecting the contact parts to the carrier strip, and d) plastically deforming the shaft of the at least one fastening element, wherein the step of providing the contact parts comprises fixedly fastening the fastening element to the contact part.

Further embodiments are set forth in the dependent claims.

BRIEF DESCRIPTION OF THE DRAWINGS

Preferred embodiments of the invention will be described below on the basis of the drawings, which serve merely for explanation and are not to be interpreted as being restrictive. The drawings show.

DESCRIPTION OF PREFERRED EMBODIMENTS

The figures show various embodiments of a contact element 1 according to the invention. In this case, the contact element 1 establishes electrical contact between a first contact piece and a second contact piece. To this end, the contact element 1 makes contact with a contact face of one contact piece and with a contact face of the other contact piece. Owing to its resilient properties that will be described in greater detail in the text that follows, the contact element is always pressed against the two contact faces of the contact pieces in the contact position.

Figure 1:
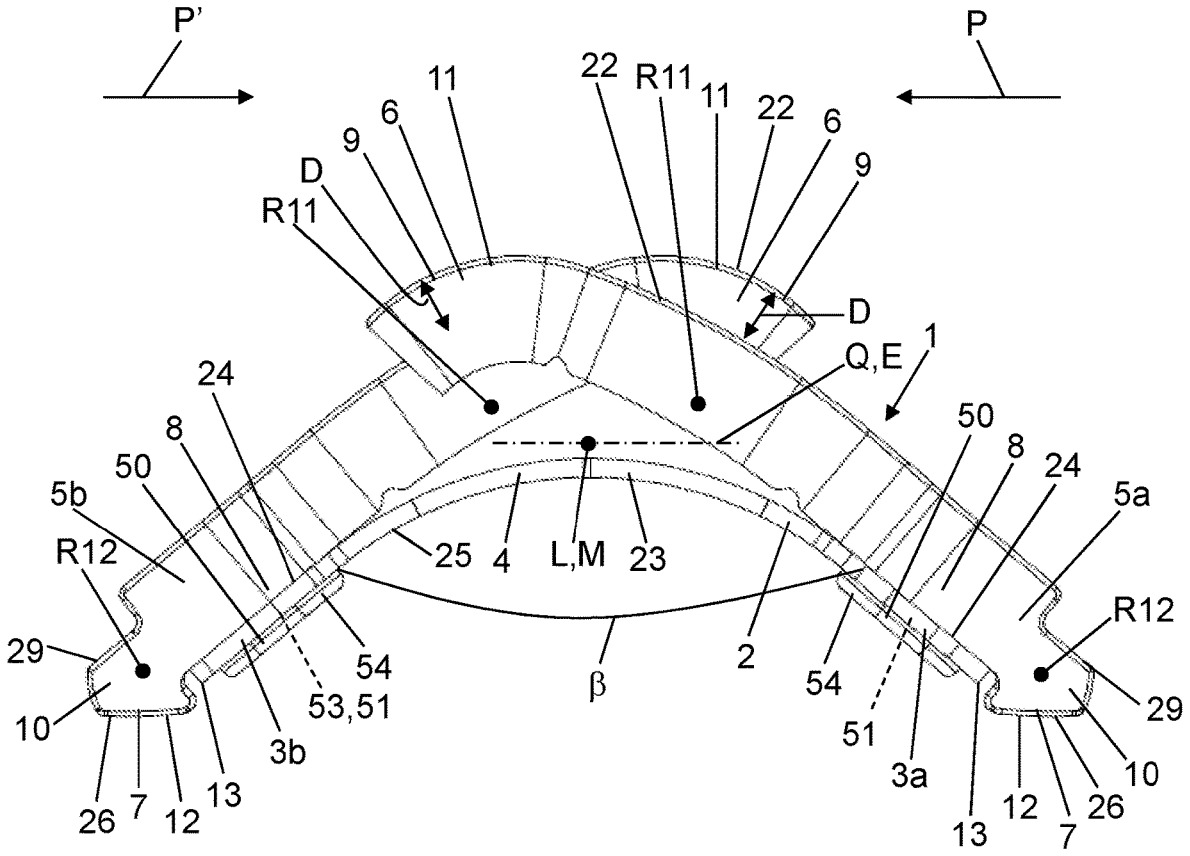
FIG. 1 a side view of a contact element according to the present invention.
Figure 2:
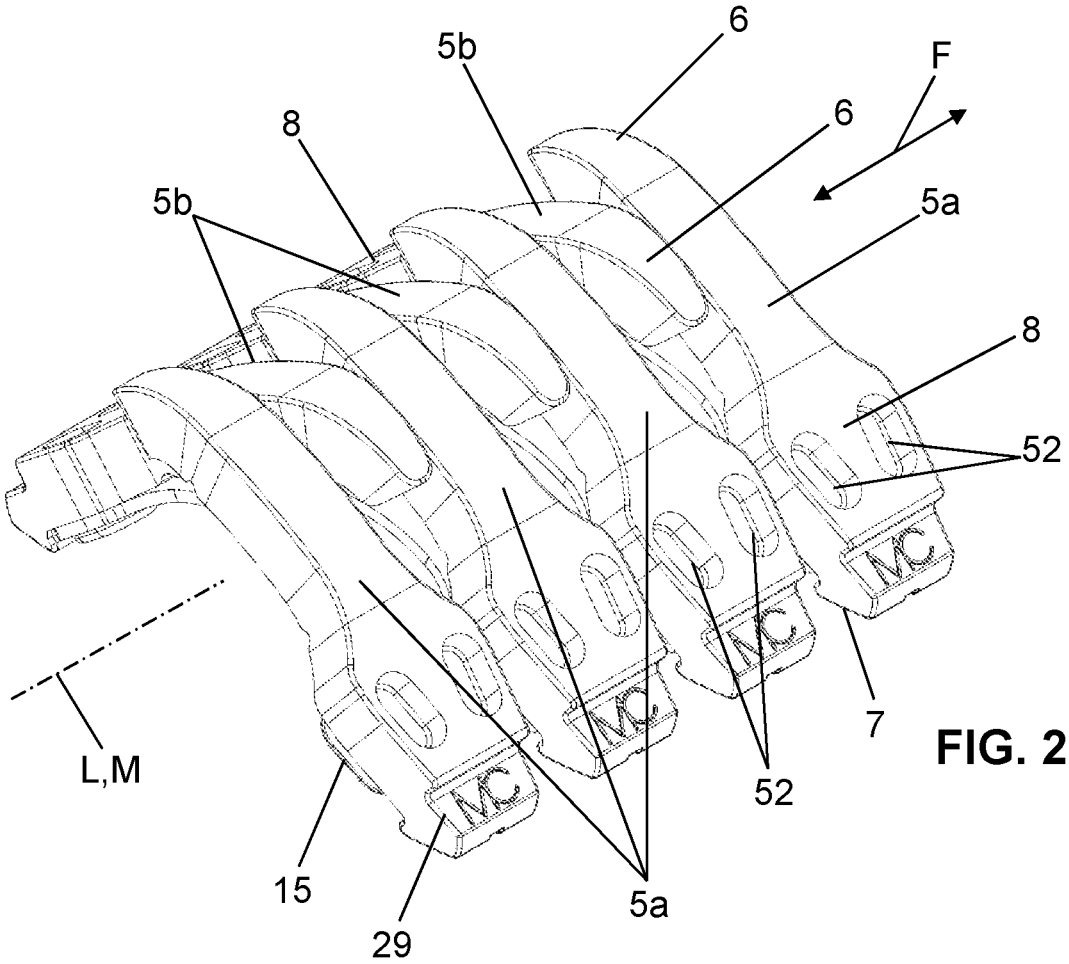
FIG. 2 a perspective view of the contact element according to FIG. 1 from above.
Figure 3:
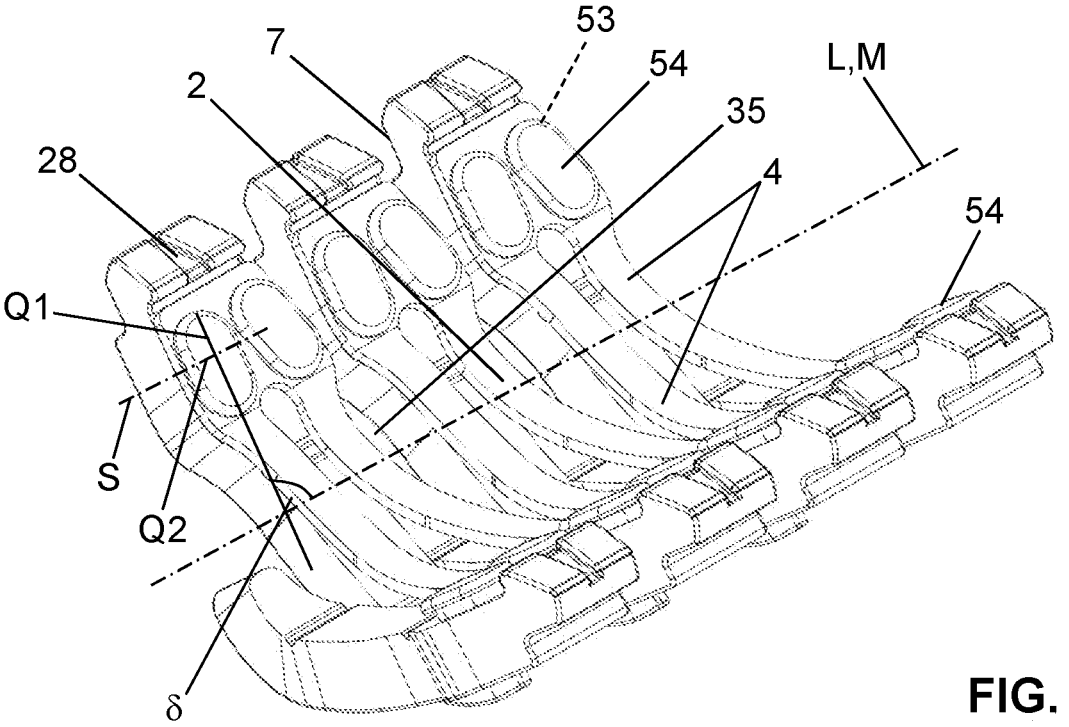
FIG. 3 a perspective view of the contact element according to FIG. 1 from below.
Figure 4:
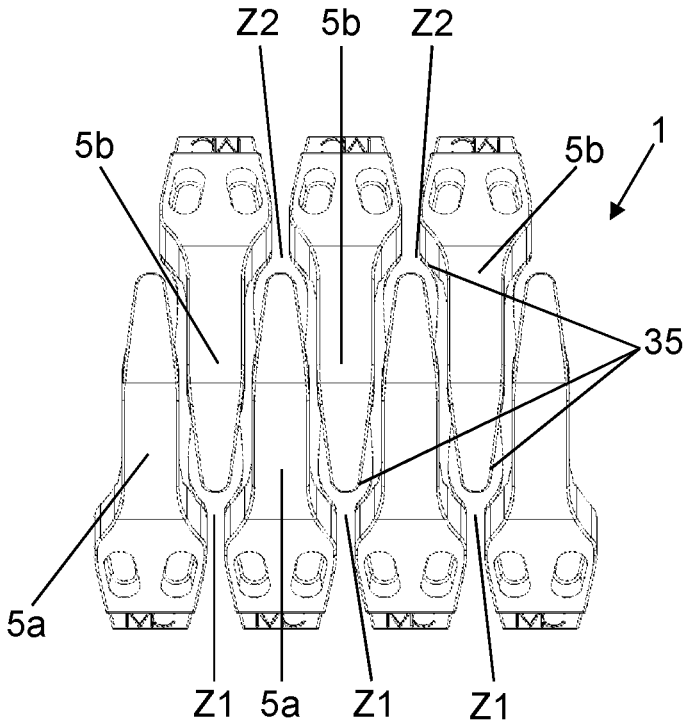
FIG. 4 a plan view of the contact element according to FIG. 1.

According to all of the embodiments, the contact element 1 for establishing electrical contact between the two contact pieces comprises a carrier strip 2 that extends in the longitudinal direction L and a plurality of contact parts 5, 5*a*, 5*b* that are connected to the carrier strip 2. The carrier strip 2 serves to support the contact parts 5 and not to establish electrical contact, whereas the contact parts 5 are provided for establishing electrical contact. In FIG. 1, the longitudinal direction L runs at a right angle in relation to the surface of the drawing sheet. Depending on the installation position of the contact element, the longitudinal direction L can be curved or extend along a straight line. For example, when the contact element 1 is installed into a socket/plug combination, the longitudinal direction L is formed in a circumferential manner about a center axis. When two contact pieces, which are substantially flat, are contact-connected, the longitudinal direction L can extend along a straight line.

As will be discussed further below, the carrier strip 2 can be of flexible or rigid design in its longitudinal direction L. FIGS. 1 to 6 show a carrier strip 2 that is of flexible design in the longitudinal direction L, while FIGS. 7 to 12 show a carrier strip 2 that is substantially rigid in the longitudinal direction L. Irrespective of the shape of the carrier strip 2, the contact parts 5, 5*a*, 5*b* are connected to the carrier strip 2 by means of fastening spots 3.

The contact parts 5 each comprise a first contact section 6 for making contact with one of the two contact pieces, a second contact section 7 for making contact with the other of the two contact pieces, and also a fastening section 8 for fastening the contact part 5 to a fastening spot 3 of the carrier strip 2.

Each of the contact parts comprises at least one connecting element 50 for fastening the contact part 5, 5*a*, 5*b* to the carrier strip 2. The connecting element 50 is provided on the fastening section 8.

In all of the embodiments shown, the at least one connecting element 50 is an integral constituent part of the contact part 5, 5*a*, 5*b*. That is to say, the at least one connecting element 50 is formed in one piece with the contact part 5, 5*a*, 5*b*. The contact part 5 and the connecting element 50 therefore form a one-piece structure. The at least one connecting element 50 has a shaft 51 that protrudes away from the fastening section 8, which shaft 51 is plastically deformed in a forming process in such a way that a mechanically fixed connection is provided between the contact part 5*a*, 5*b* and the carrier strip 2.

Figure 5:
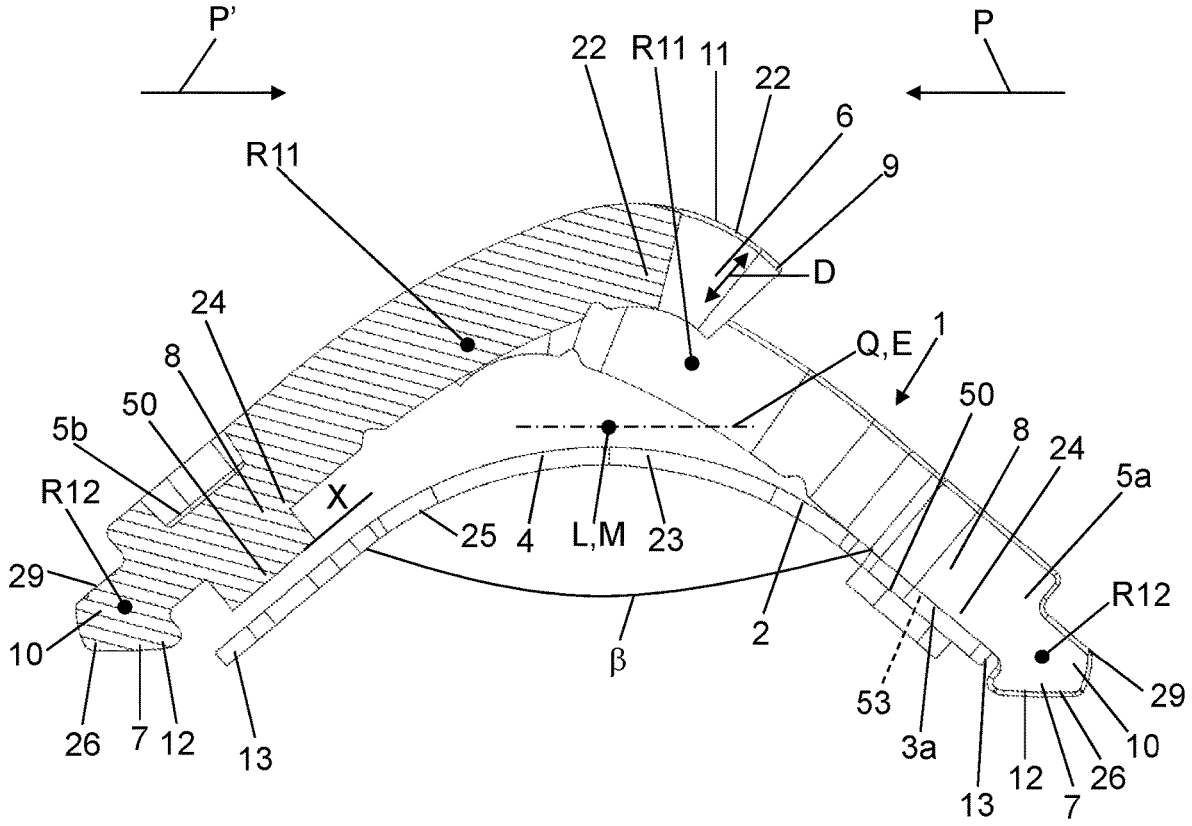
FIG. 5 a sectional view through the contact element according to FIG. 1 with the contact part not yet fastened.

In FIG. 5, the contact part 5B is illustrated at a distance from the carrier strip 2. The connecting element 50 has not yet been shaped here. The contact part 5*b* is moved toward the carrier strip 2 and the connecting element 50 then protrudes through the fastening opening 53.

Figure 6:
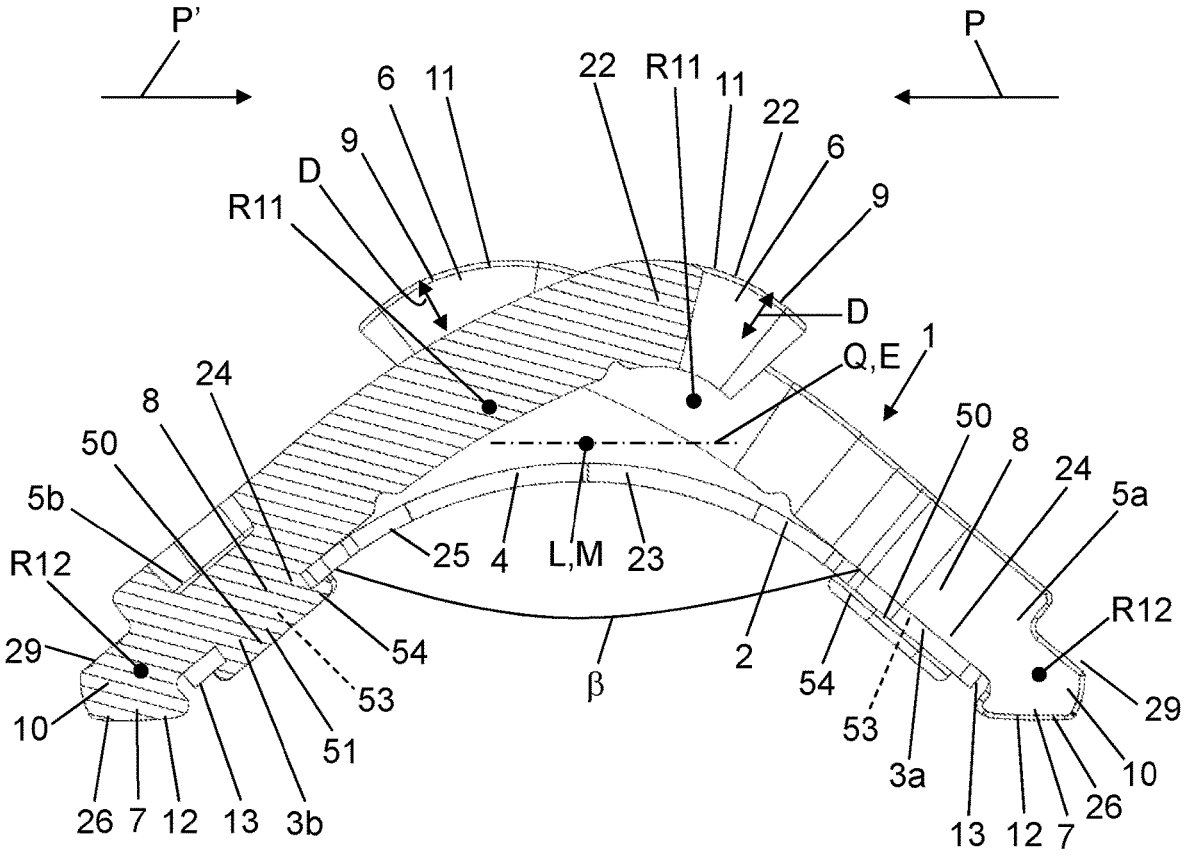
FIG. 6 a sectional view through the contact element according to FIG. 1 with the contact part fastened.

FIGS. 1 to 4 and 6 and also FIGS. 7 to 12 show the connecting element in the shaped state. In the embodiment shown, the shaft 51 is shaped in such a way that a head section 54 is formed, wherein the head section 54 is pressed against the carrier strip 2. As shown in FIGS. 5 and 6, the shaft 51 extends through a rivet opening 53 that is arranged in the carrier strip 2. However, in addition, the outside diameter of the shaft 51 is also deformed and in the process pressed against the wall 55 of the fastening opening. The same also applies for the embodiments of FIGS. 7 to 12.

In an alternative, not shown, it would also be conceivable that only the shaft 51 is shaped, wherein the diameter of the shaft 51 is then increased in size, so that the shaft 51 is pressed against the wall 55 in the interior of the fastening opening 53. The shaft 51 is held in the interior of the fastening opening 53 in a force-fitting manner here.

Here, the connecting element 50 is plastically deformed in the region of the bottom side 25 of the carrier strip in such a way so that a head section 54 is formed, with which head section the carrier strip 2 is clamped to the contact part 5, 5*a*, 5*b*. The connecting element 50 protrudes through the carrier strip 2 through a fastening opening 53. The fastening opening 50, in particular the shaft 51, and the fastening opening 53 have substantially the same cross section. Here, the fastening opening 53 is in the shape of an elongate hole and the shaft 51 is designed to be complementary to or match said elongate hole.

As mentioned, in all of the embodiments shown, the at least one connecting element 50 is formed in one piece on the contact part 5, 5*a*, 5*b* by means of the fastening section 8. In the embodiment shown, the at least one connecting element 50 is formed from the fastening section 8. In this case, the at least one connecting element 50 is pressed out of the fastening section 8 by means of a stamping process or punch-through process. By way of the stamping tool or a punch-through tool, the fastening section 8 is plastically deformed from the top side 22 and the connecting elements are pressed out on the bottom side 26 of the contact element 5, 5*a*, 5*b*.

This press-out operation produces an indentation 52 opposite the connecting element 50. The volume of the indentation 52 corresponds substantially to the volume of the connecting element 50 that has been pressed out.

In the embodiment according to FIGS. 1 to 6, two connecting elements 50 are provided for each contact part 5, 5*a*, 5*b*. In the embodiment according to FIGS. 7 and 8 and FIGS. 11 to 12, two connecting elements 50 are likewise provided for each contact part 5, wherein in each case one of the connecting elements 50 is arranged on a respective fastening section 8. One connecting element 50 is provided in the embodiment according to FIGS. 9 to 10.

The carrier strip 2 has fastening openings 53 for receiving the connecting elements 50. The number of fastening openings 53 and the position thereof is matched to the number and to the position of the connecting elements 50. The fastening openings 53 in the carrier strip are produced, for example, by a punching process. Before the plastic deformation, the connecting element 50, by way of its shaft 51, protrudes beyond the carrier strip 2. After the plastic deformation, the shaft 51 extends through the fastening opening 53 and the head section 54 protrudes beyond the carrier strip 2.

The shaft is preferably deformed over its entire cross section with respect to the protruding part. As an alternative, the shaft 51 can be selectively deformed at different subregions of its cross section. In this case, the entire cross section of the shaft 51 is not deformed, but rather only a partial cross section of the shaft 51 is deformed.

The connecting elements 50 are situated at a distance in relation to one another here, wherein the distance is, in particular, formed in such a way that the connecting elements 50 do not touch in the deformed state.

The connecting element 50 extends along a center axis S as seen from the fastening section 8.

According to the embodiment of FIGS. 1 to 6, the connecting element 50 is formed as follows: Here, the dimension of the connecting element 50 in a first transverse axis Q1, which lies transverse to the center axis S, is larger than the dimension in a second transverse axis Q2 that lies transverse to the center axis S and to the first transverse axis Q1. The first transverse axis Q1 is oriented in a manner inclined at an angle δ in relation to the longitudinal direction of the carrier strip 2. However, the transverse axis Q1 can also run at a right angle in relation to the longitudinal axis.

Figure 7:
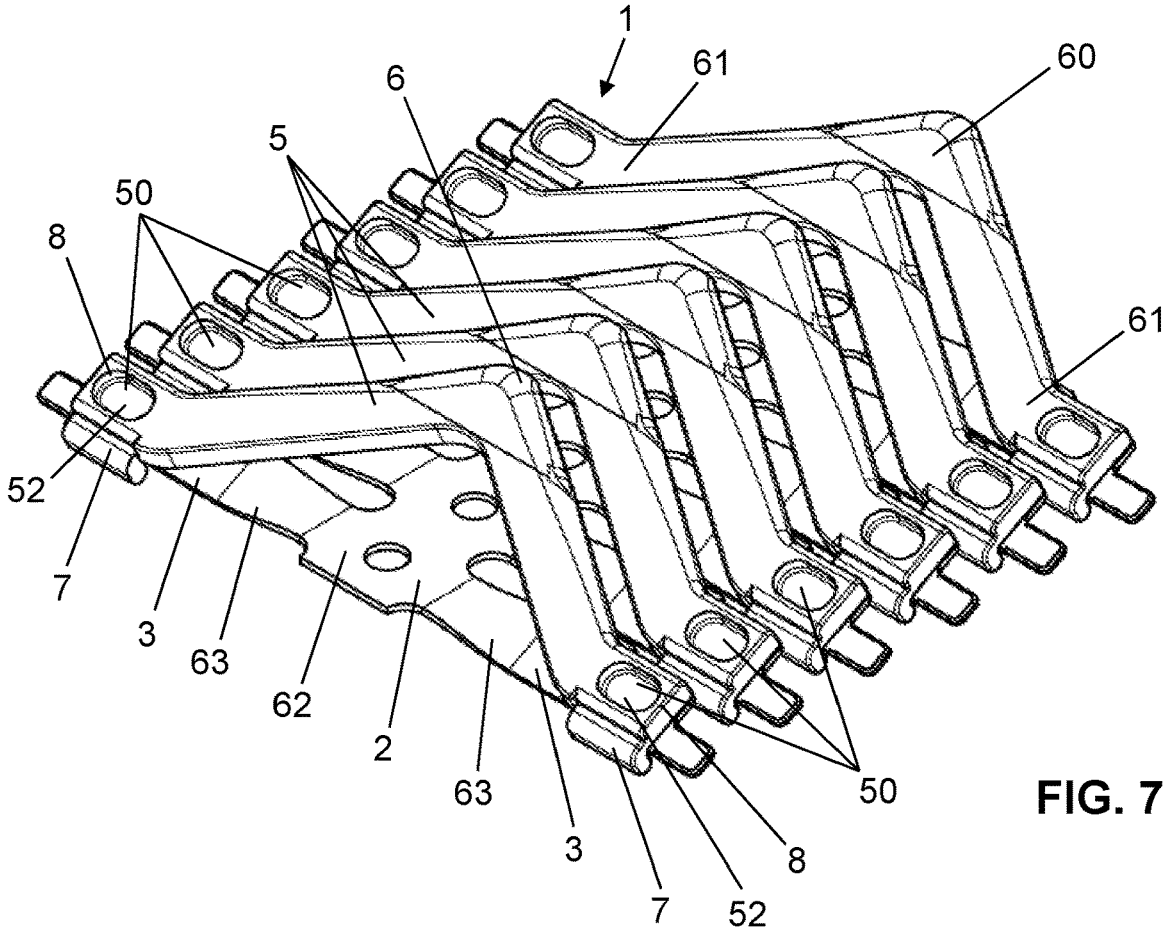
FIG. 7 a perspective view of a contact element according to a further embodiment of the present invention from above.
Figure 8:
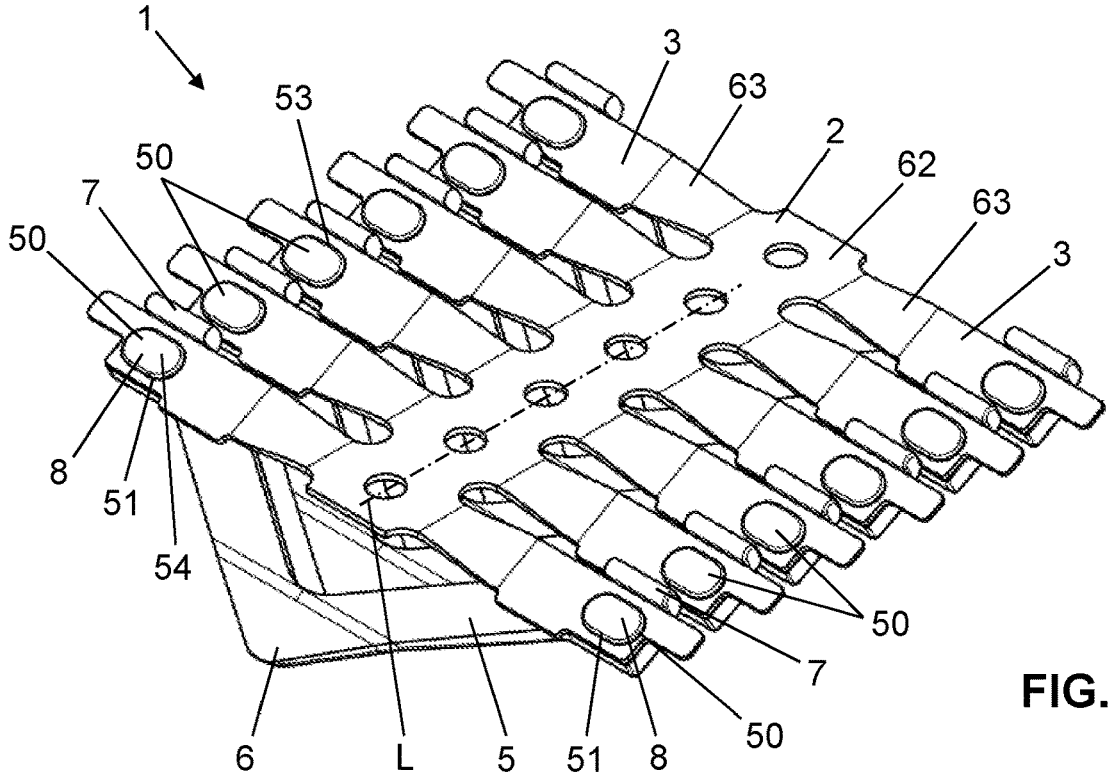
FIG. 8 a perspective view of the contact element according to FIG. 7 from below.

According to the embodiment of FIGS. 1 to 6 and also according to the embodiment of FIGS. 7 to 8, the connecting element 50 has a cross section that matches the shape of the fastening opening 53 that is in the shape of an elongate hole here.

Figure 9:
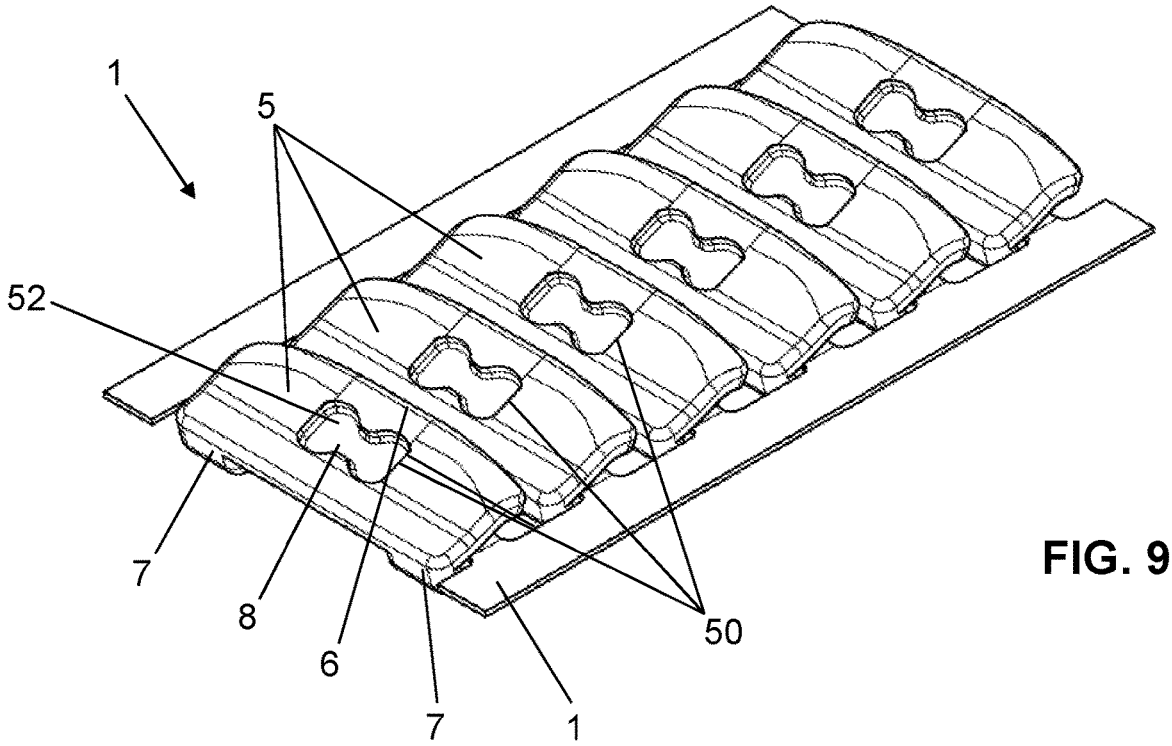
FIG. 9 a perspective view of a contact element according to a further embodiment of the present invention from above.
Figure 10:
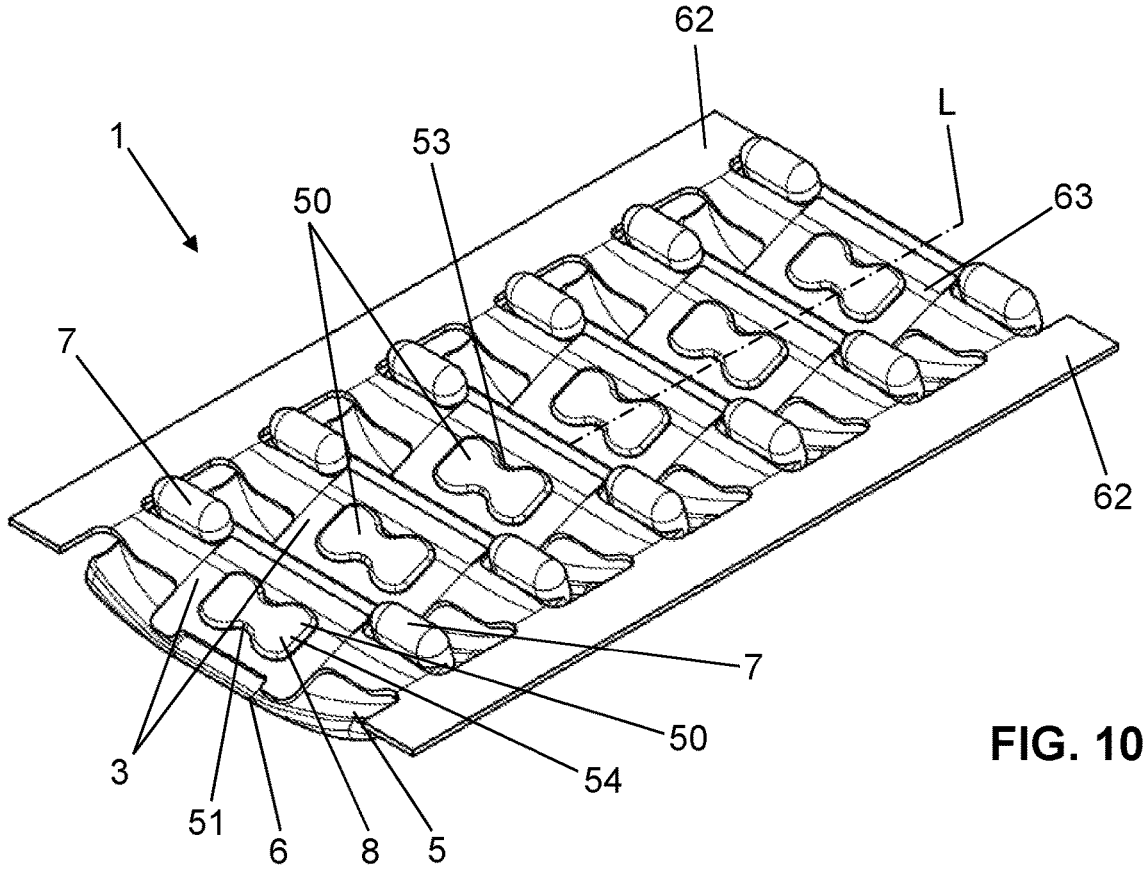
FIG. 10 a perspective view of the contact element according to FIG. 9 from below.

According to the embodiment of FIGS. 9 to 10, the connecting element 50 has a substantially rectangular cross section, wherein the rectangle has a narrowed portion at the relatively long edges. The cross section can also be called cross-shaped. The cross section can, in principle, be as desired, with the proviso that there is enough material for the deformation.

Figure 11:
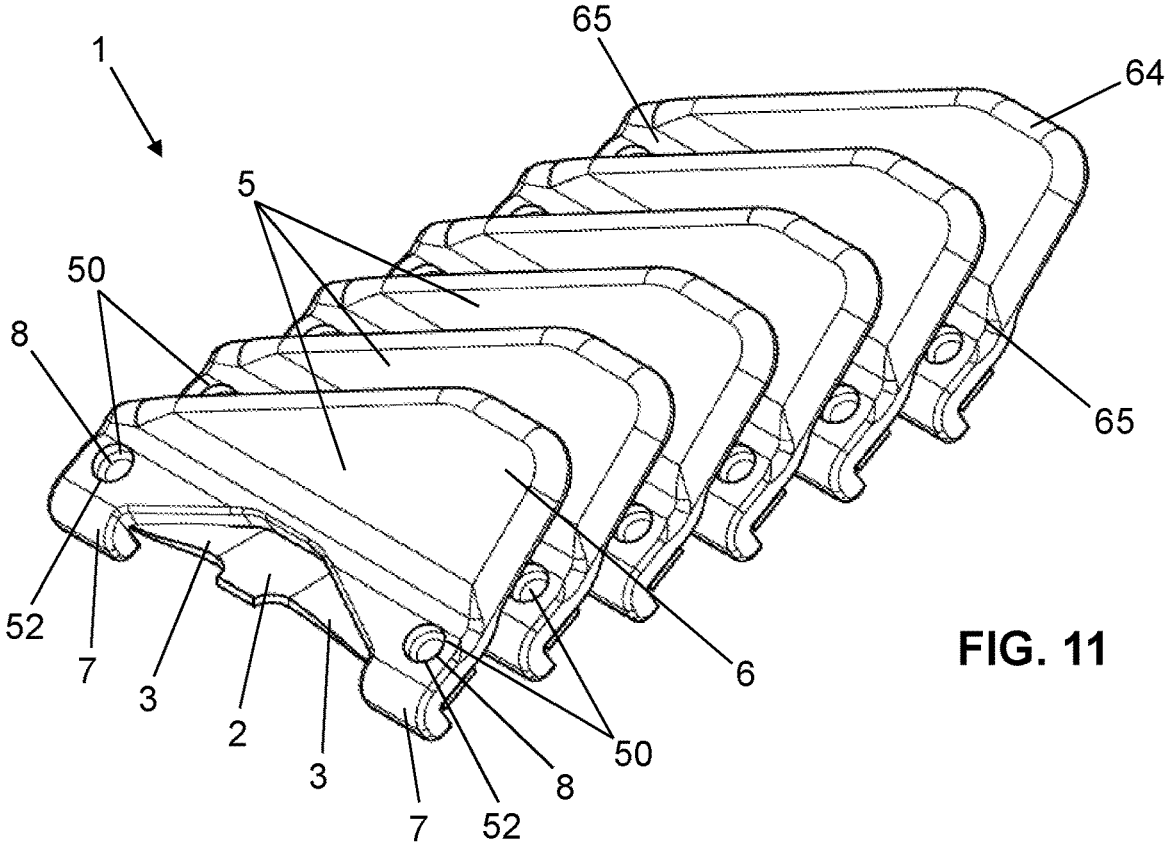
FIG. 11 a perspective view of a contact element according to a further embodiment of the present invention from above.
Figure 12:
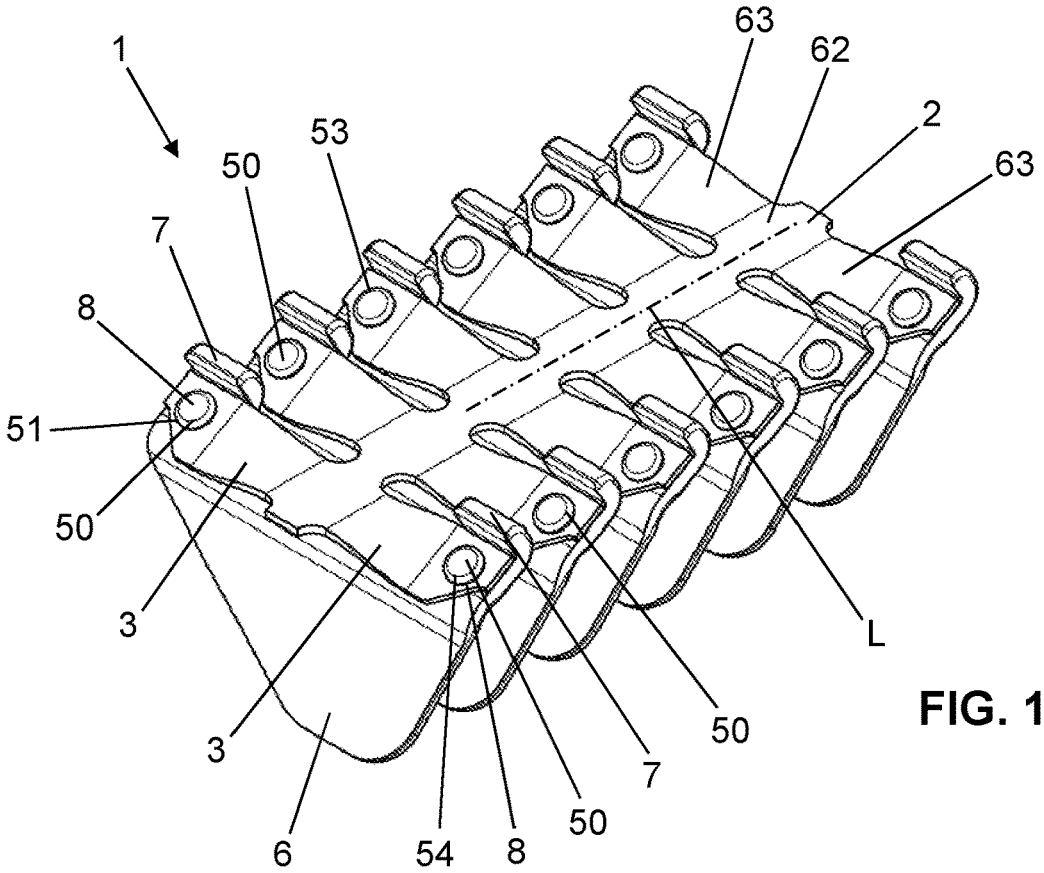
FIG. 12 a perspective view of the contact element according to FIG. 11 from below.

According to the embodiment of FIGS. 11 to 12, the connecting element 50 has a substantially round cross section.

The cross section of the connecting element 50 can be exchanged in accordance with the embodiments. However, the connecting element 50 can also have an oval cross section or an n-gonal cross section or polygonal cross section.

The fastening by way of the at least one connecting element 50 could be assisted by way of a welded or soldered connection, in addition to the mechanical fastening. The connecting element 50 could therefore be welded or soldered to the carrier strip 2.

In a second embodiment of the connecting element, the at least one connecting element is arranged fixedly on the contact part before the riveting and before the connection to the carrier strip. The second configuration can be used in all of the embodiments shown herein. That is to say, the contact part 5, 5*a*, 5*b* can be connected to the connecting element 50 before the connection to the carrier strip 2. According to the second embodiment, the at least one connecting element preferably protrudes by way of the shaft through an opening in the fastening section and is fixedly fastened to the fastening section, wherein the fastening is established in an interlocking manner and/or a force-fitting manner and/or a cohesive manner.

An exemplary carrier strip 2, to which the contact parts 5 are fastened, is shown in the embodiment of FIGS. 1 to 6. Here, the carrier strip 2 is designed in such a way that, when a force F is applied to the carrier strip 2, said carrier strip is compressed or extended in the longitudinal direction L. The carrier strip 2 is therefore designed in a manner such that its length can be changed. The change in the length of the carrier strip 2 is preferably performed in the elastic region. The force F is symbolized as a double-headed arrow in FIG. 2. However, the carrier strip can also be designed in some other way. For example in a rigid manner.

In the embodiment shown, the carrier strip 2 comprises a plurality of fastening spots in the form of fastening lugs 3. In this case, the fastening lugs 3, as seen in the longitudinal direction L, are spaced in relation to one another. Two rows of fastening lugs 3 are provided in the embodiment shown. One row comprises first fastening lugs 3*a* that are arranged one behind the other in the longitudinal direction L, and the other comprises second fastening lugs 3*b* that are likewise arranged one behind the other in the longitudinal direction L. The two rows therefore extend in the longitudinal direction L, wherein the rows are at a distance in relation to one another in a transverse direction that runs transverse to the longitudinal direction. The distance between the fastening lugs 3 is identical in both rows. However, the first fastening lugs 3*a* are arranged in a manner offset by an offset in relation to the second fastening lugs 3*b* in the longitudinal direction L.

The figures show a symmetrical arrangement of the fastening lugs 3 with respect to the longitudinal direction L. An asymmetrical arrangement is likewise conceivable.

A center line M that likewise extends in the longitudinal direction L lies centrally between the row of first fastening lugs 3*a* and the row of second fastening lugs 3*b*. The first fastening lugs 3*a* and the second fastening lugs 3*b* are at a transverse distance in relation to the center line M with respect to the transverse direction.

The contact parts 5 are fastened to the carrier strip 2 at the fastening lugs 3. If the force F is now applied to the carrier strip 2, the distance between the fastening lugs 3 changes and there is therefore also a change in the distance between the contact parts 5.

In the embodiment shown, in each case two fastening lugs 3 that immediately follow one another in the longitudinal direction L are connected to one another by means of a web 4. Here, the web 4 extends in a manner inclined at an angle in relation to the longitudinal direction L. In the embodiment shown, a first web 4*a* extends from a first fastening lug 3*a* to a second fastening lug 3*b*. The web 4 is respectively formed on the inner edges 21 of the respective fastening lug 3*a*, 3*b*. In this case, the inner edge 21 is that edge of the fastening lug 3*a*, 3*b* that faces the respective other fastening lug 3*b*, 3*a*. A second web 4*b* extends to a further first fastening lug 3*a*. In this case, the web 4*b* extends away from the same inner edge 21 of the second fastening lug 3*b* on which the first web 4*a* is formed on. The second web 4*b* is likewise inclined at an angle in relation to the longitudinal direction L.

In other words: The webs 4*a*, 4*b* extend alternately from a fastening lug 3*a* in the first row to a fastening lug in the second row 3*b*, and vice versa. A meandering structure of the carrier strip 2 that can be easily deformed in respect of its length is achieved owing to the arrangement in this way of the fastening lugs 3*a*, 3*b* and of the webs 4*a*, 4*b*.

This arrangement of the webs 4 and of the fastening lug 3 is then repeated many times over the longitudinal direction L, so that the actual carrier strip 2 that has a large number of fastening lugs 3 and webs 4 can be provided.

As mentioned above, the carrier strip can also be designed in some other way. As an alternative, the carrier strip 2 can be designed in such a way that it is substantially not deformed in the longitudinal direction L when a force F is applied to the carrier strip 2. In this variant, the carrier strip 2 is designed in a manner such that its length cannot be changed. A carrier strip 2 of this kind can be formed from a flat strip, the thickness of said strip being several times smaller than the width of said strip.

In the embodiment shown according to FIGS. 1 to 6, a first contact part 5*a*, by way of its fastening section 8, is connected to a first fastening lug 3*a* in each case. A second contact part 5*b*, in each case by way of its fastening section 8, is connected to a second fastening lug 3*b*. The first contact part 5*a*, which is connected to the first fastening lug 3*a*, is oriented, by way of its first contact section 6, toward the second contact part 5*b*, which is connected to the second fastening lug 3*b*. The first contact section 6 therefore protrudes toward the second contact part 5*b*. Similarly, the second contact part 5*b*, which is connected to the second fastening lug 3*b*, is oriented, by way of its first contact section 6, toward the first contact part 5*a*, which is connected to the first fastening lug 3*a*. In this case, the contact parts 5*a*, 5*b* are arranged in such a way that the respective first contact sections 6 extend from the fastening lug 3*a*, 3*b* beyond the center line M that extends centrally between the two fastening sections 3*a*, 3*b* in the longitudinal direction L. That is to say, the first contact sections 6 of the respective contact parts are situated at least partially on the other side with respect to the center line M.

FIG. 1 additionally shows that the webs 4 are designed such that they are bent once or bent several times about a center line M that lies between the fastening lugs 3*a*, 3*b*, so that the surface 24 of the fastening lugs 3*a*, which are arranged on one side of the center line M, are situated in a manner inclined at an angle in relation to the surface 24 of the fastening lugs 3*b* that are arranged on the other side of the center line M. The bending spot is in each case provided with the reference symbol 23 and the angle between the first fastening lugs 3*a* and the second fastening lugs 3*b* is indicated by (3.

FIGS. 1 to 6 additionally show that in each case one second contact part 5*b* extends into the intermediate space Z1, Z2 that is situated between two adjacent first contact parts 5*a*. A first contact part 5*a* extends between two second contact parts 5*b*, which are arranged adjacent to one another, into the intermediate space Z2. An interleaved structure is therefore produced.

In the embodiment according to FIGS. 1 to 6, the first contact section 6 of the contact part 5, 5*a*, 5*b* forms a free end 9 that protrudes from the carrier strip 2. The free end 9 therefore does not abut against the carrier strip 2, but rather extends from the fastening section 8 away from the carrier strip 2.

In the deflected state, the free ends 9 can protrude through the carrier strip 2 through a recess 35 in the carrier strip 2. The recess 35 is preferably provided by the intermediate region between two webs 4.

The fastening section 8 abuts flat against the carrier strip 2.

Depending on the type of fastening of the contact part 5, 5*a*, 5*b*, the second contact section 7 is likewise a free end or abuts on the bottom side 25 of the carrier strip 2. This will be discussed further in the text that follows in connection with the fastening of the contact parts 5, 5*a*, 5*b*.

In the embodiment according to FIGS. 1 to 6, the second contact section 7 of the contact part 5, 5*a*, 5*b* is arranged in relation to the carrier strip 2 in such a way that the carrier strip 2 is not connected to the contact piece in the contact position. The second contact section 7 is designed as a kind of raised portion 29 and is spaced from the bottom side of the carrier strip 2.

In the embodiment according to FIGS. 1 to 6, the contact part 5 is designed with a rounded portion 11 in the first contact section 6. The rounded portion 11 relates, in particular, to the top side 22 of the contact part in the first contact section 6 since contact is also made at the respective contact face by means of the top side 22. Depending on the design, the bottom side 26 of the contact part 5, 5*a*, 5*b* can also be rounded. The rounded portion 11 extends around a rounded portion axis R11 with a constant or changing rounded portion radius. The rounded portion axis R11 preferably extends parallel in relation to the longitudinal direction L.

In the embodiment according to FIGS. 1 to 6, the second contact section 7 of the contact part 5, 5*a*, 5*b* is also designed in a rounded manner with a rounded portion 12. The rounded portion 12 extends around a rounded portion axis R12 with a constant or changing rounded portion radius. The rounded portion axis R12 preferably extends parallel in relation to the longitudinal direction L.

In the embodiment according to FIGS. 1 to 6, the second contact section 7 is situated in the region of the fastening section 8. That is to say, the second contact section 7 and the fastening section 8 are situated physically close to one another.

In the embodiment according to FIGS. 1 to 6, the rounded portion radius R11 of the rounded portion 11 of the first contact section 6 can be different from the rounded portion radius R12 of the rounded portion 12 of the second contact section 7. The rounded portion radii R11, R12 can also be the same.

In the embodiment according to FIGS. 1 to 6, the cross section of the contact part 5, 5*a*, 5*b* in the region of the fastening section 8 is larger than in the region of the first contact section 6. The first contact section 6 is therefore designed in a tapered manner in relation to the fastening section 8. The change in cross section can have different geometries.

In the embodiment according to FIGS. 1 to 6, the cross section of the contact part 5, 5*a*, 5*b* as seen in the region of the fastening section 8 is larger than the cross section of the contact part 5, 5*a*, 5*b* in the region of the second contact section 7. The second contact section 7 is therefore designed in a tapered manner in relation to the fastening section 8. The change in cross section can have different geometries. However, the degree of taper in the second contact section 7 is preferably smaller than in the first contact section 6.

In the shown embodiment, the second contact section 7 has an optional indentation 28 that, as seen centrally through the second contact section 7 and transverse to the longitudinal direction L, extends into the second contact section 7. A defined division of the contact faces can be achieved by way of the indentation 28, as a result of which the contact resistance is more accurately definable.

The contact part 5 further has a raised portion 29 in the region of the outer edge 13 of the fastening lug 3. The raised portion 29 then adjoins the second contact section 7. Owing to the raised portion 29, the fastening section 8 is situated in a manner offset to the rear from the contact section 7, so that the fastening lug 3 and the head section 54 are likewise offset from the contact section 7 in such a way that they do not have a negative influence on the contact process.

The contact part 5 is in the form of a bow in the embodiment of FIGS. 7 and 8. In this case, the first contact section 6 is arranged in the region of the bow bend 60 and a second contact section 7 is arranged at each of the free ends 61 of the bow. A respective fastening section 8 is arranged in each region of the two second contact sections 7. A connecting element 50 is in each case arranged in each fastening section 8, as described above.

In the embodiment of FIGS. 7 and 8, the carrier strip 2 comprises fastening webs 63 that protrude away from either side of a main web 62. The fastening webs 63 form, at the ends, a fastening lug 3 comprising the fastening openings 53. In addition, the fastening webs 63 act as a spring element, in particular as a torsion spring element.

The contact part 5 is in the form of a rectangular part in the embodiment of FIGS. 9 and 10. The first contact section 6 is formed substantially by one of the relatively long side edges, wherein the contact section 6 is of slightly cambered design. In the embodiment shown, in each case two second contact sections 7 are provided for each contact part 5. The fastening section 8 with the connecting element 50 is situated substantially in the center of the contact part 5 and is arranged as described above.

In the embodiment of FIGS. 9 and 10, the carrier strip 2 comprises fastening webs 63 that protrude away from two parallel main webs 62 and connect the two main webs 62. The fastening webs 63 form, in the center, a fastening lug 3 comprising the fastening opening 53. In addition, the fastening webs 63 act as a spring element, in particular as a torsion spring element.

The contact part 5 is in the form of a triangle in the embodiment of FIGS. 11 and 12. In this case, the first contact section 6 is arranged in the region of the triangle tip 64 and a second contact section 7 is arranged at each of the other tips 65. A respective fastening section 8 is arranged in each region of the two second contact sections 7. A connecting element 50 is in each case arranged in each fastening section 8, as described above.

The carrier strip is designed according to the embodiment in line with FIGS. 7 and 8.

Figure 13:
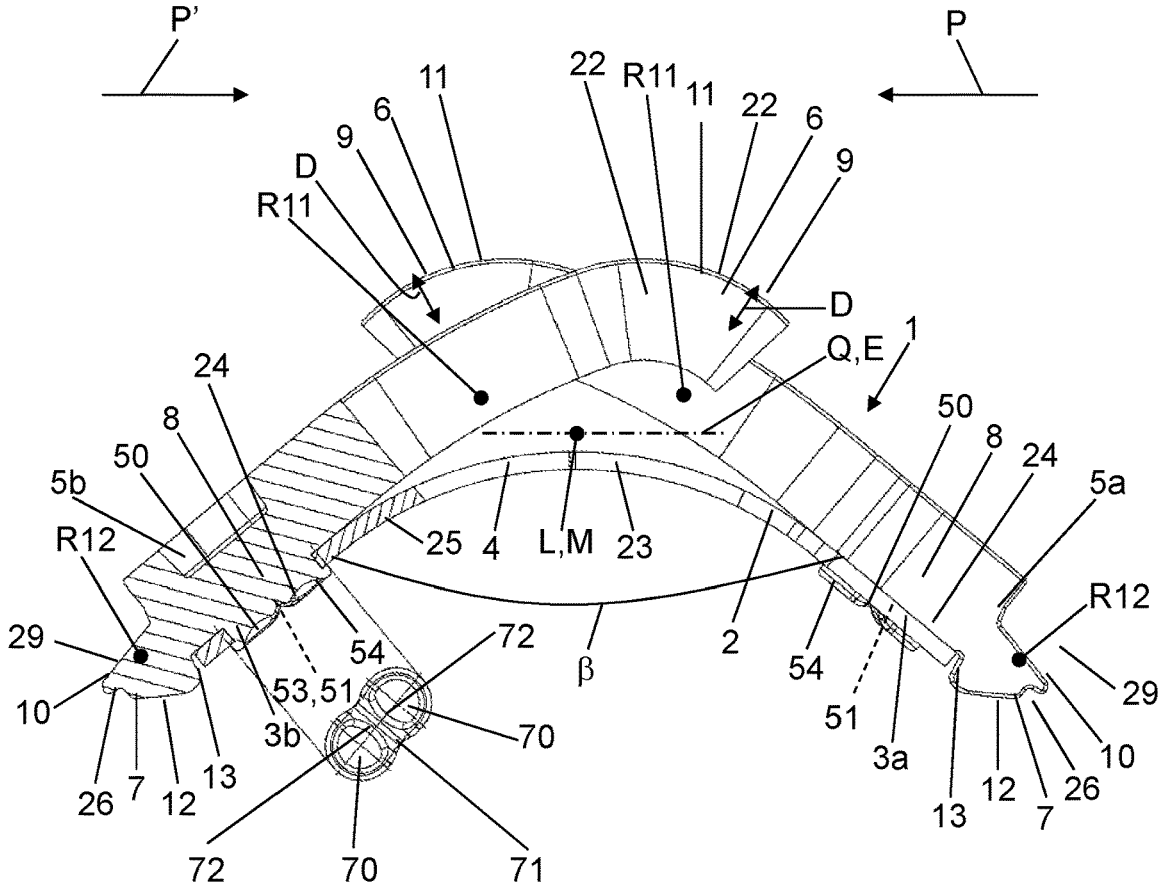
FIG. 13 a partially sectioned side view of the contact element according to a further embodiment of the present invention from above.
Figure 14:
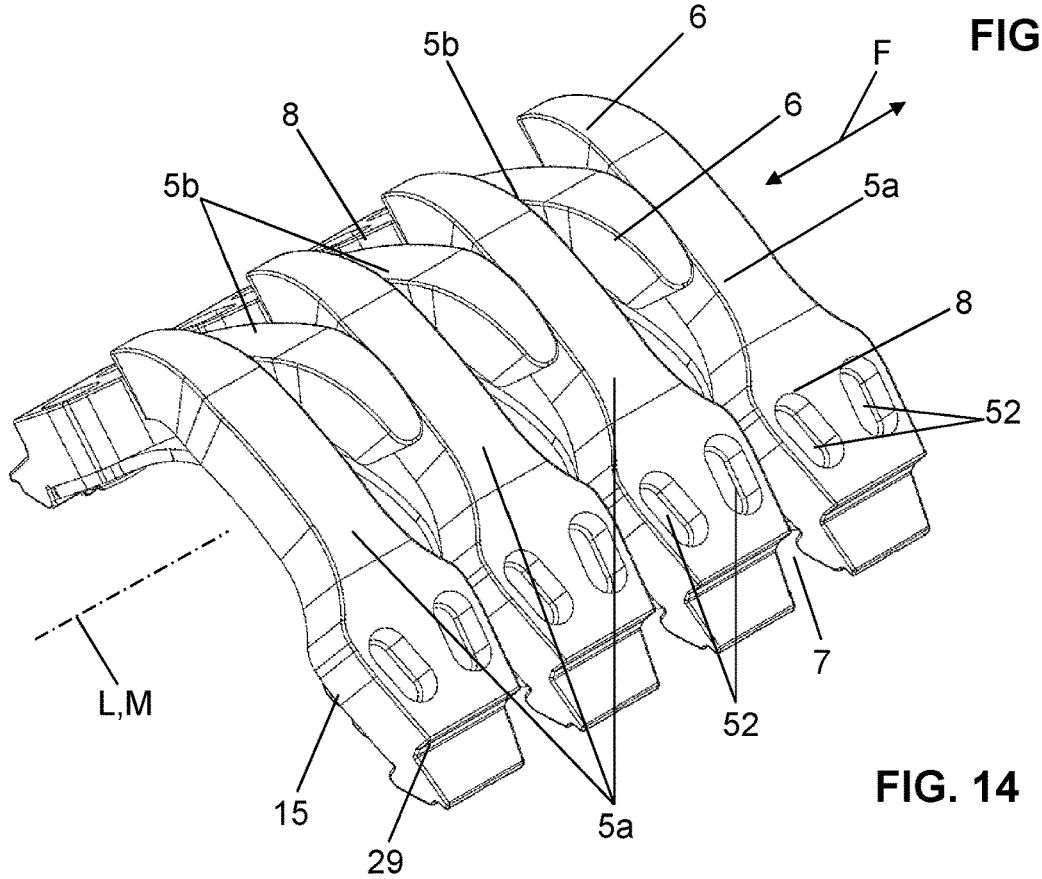
FIG. 14 a perspective view of the contact element according to FIG. 13 from below.
Figure 15:
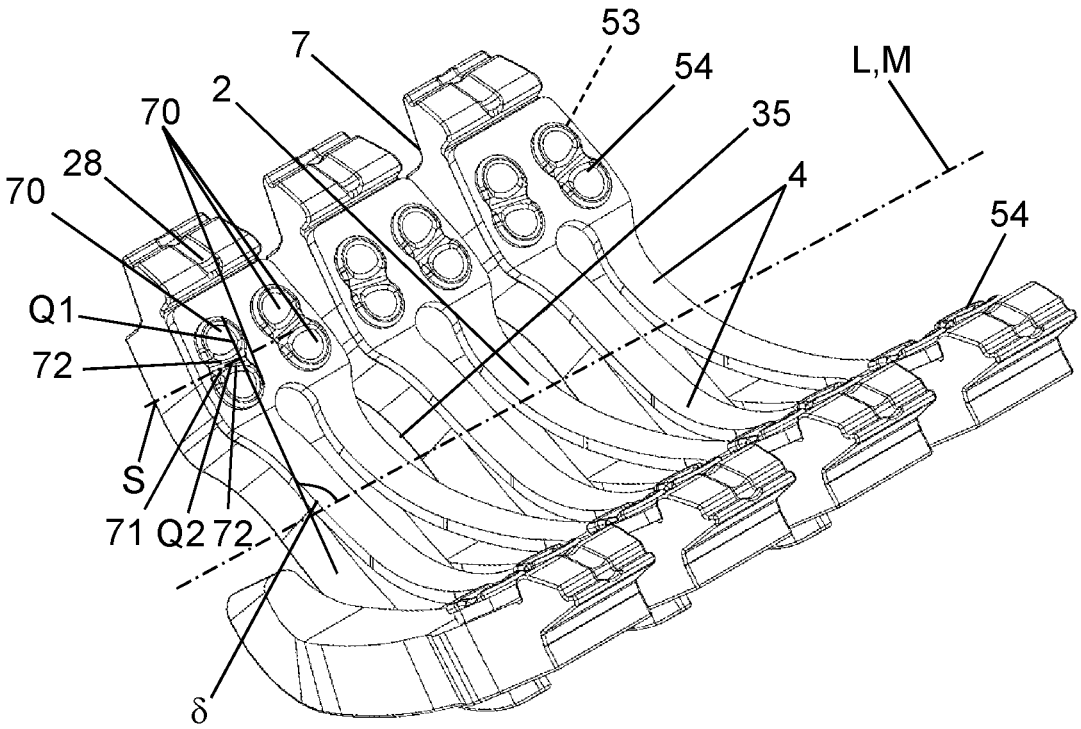
FIG. 15 the perspective view of a contact element according to FIGS. 13 and 14 from below.

FIGS. 13 to 15 show a further embodiment. Identical parts are provided with the same reference symbols. This further embodiment differs from the embodiment described in connection with FIGS. 1 to 6 substantially by virtue of the deformation of the connecting element 50.

The connecting element 50, as seen from the fastening section 8, extends along a shaft axis S. Here, the dimension in a first transverse axis Q1 that lies transverse to the shaft axis S is larger than the dimension in a second transverse axis Q2 that lies transverse to the shaft axis S and transverse to the first transverse axis Q1. The shaft 51 is selectively deformed at different subregions 70 of its cross section. In the embodiment shown, the shaft 51 is deformed at exactly two subregions 70 that are situated opposite one another with respect to the second transverse axis Q2.

In the embodiment shown, the deformation is polygonal and, in the region of the outer side of the shaft 51, fits with the shape of the shaft 51. The deformation is provided with a rounded portion 72 in the region 71 between the two subregions 70 that are deformed. There can be an optional indentation, which can be produced by the deformation, in the region 71 between the two subregions.

| LIST OF REFERENCE SIGNS | |
|---|---|
| 1 | Contact element |
| 2 | Carrier strip |
| 3, 3a, 3b | Fastening lugs |
| 4 | Web |
| 5, 5a, 5b | Contact part |
| 6 | First contact section |
| 7 | Second contact section |
| 8 | Fastening section |
| 9 | Free end |
| 11 | Rounded portion |
| 12 | Rounded portion |
| 13 | Outer edge |
| 21 | Inner edge |

-continued

| LIST OF REFERENCE SIGNS | |
|---|---|
| 22 | Top side |
| 23 | Bending spot |
| 24 | Surface |
| 25 | Bottom side |
| 26 | Bottom side |
| 28 | Indentation |
| 29 | Raised portion |
| 35 | Recess |
| 50 | Connecting element |
| 51 | Shaft |
| 52 | Indentation |
| 53 | Fastening opening |
| 54 | Head section |
| 55 | Wall |
| 60 | Bow bend |
| 61 | Free ends |
| 62 | Main web |
| 63 | Fastening web |
| 64 | Triangle tip |
| 65 | Tip |
| 70 | Subregion |
| 71 | Region |
| 72 | Rounded portion |
| S | Shaft axis |
| Q1 | First transverse axis |
| Q2 | Second transverse axis |
| C | Transverse distance |
| L | Longitudinal direction |
| M | Center line |
| P, P' | Arrow |
| Z1 | Intermediate space |
| Z2 | Intermediate space |
| F | Force |
| X | Length |
| R11 | Rounded portion axis |
| R12 | Rounded portion axis |
| δ | Angle |

The invention claimed is:

1. A contact element for establishing electrical contact between two contact pieces, comprising:

a carrier strip that extends in a longitudinal direction; and a plurality of contact parts each having at least one first contact section for making contact with one of the two contact pieces, at least one second contact section for making contact with the other of the two contact pieces, and also having at least one fastening section for fastening the contact part to a fastening spot at the carrier strip, wherein each contact part comprises at least one plastically deformable connecting element for fastening the contact part to the carrier strip, wherein the at least one connecting element is an integral constituent part of the contact part, and wherein the at least one connecting element has a shaft that protrudes away from the at least one fastening section and that is guided through a fastening opening in the carrier strip, wherein the shaft is plastically deformed in a forming process in such a way that the shaft forms a mechanically fixed connection with the carrier strip, wherein the at least one connecting element is formed in one piece with the contact part by means of the fastening section, wherein the at least one connecting element is formed from the fastening section, and wherein the at least one connecting element is pressed out of the fastening section by means of a stamping process or a punch-through process and wherein the fastening section comprises an indentation opposite the connecting element, wherein the volume of the indentation corresponds substantially to the volume of the connecting element that has been pressed out.

2. The contact element according to claim 1, wherein the mechanically fixed connection is a force-fitting connection and/or an interlocking connection and/or a cohesive connection.

3. The contact element according to claim 1, wherein the at least one connecting element is formed in one piece with the contact part by means of the fastening section.

4. The contact element according to claim 1, wherein the shaft, from the side of the carrier strip on which the contact parts are arranged, extends substantially completely through the fastening opening, and wherein the shaft is plastically deformed on that side of the carrier strip that is situated opposite the contact part.

5. The contact element according to claim 1, wherein, for the purpose of mechanical connection, the shaft is pushed against the wall of the fastening opening owing to the forming process.

6. The contact element according to claim 1, wherein for the purpose of mechanical connection, the connecting element, by way of its shaft, protrudes beyond the carrier strip before the plastic forming, and wherein a head section is formed at the protruding end of the shaft by the forming process, the dimension of said head section transverse to the shaft axis being larger than the cross section of the fastening opening.

7. The contact element according to claim 1, wherein for the purpose of mechanical connection, the shaft is pressed against the wall of the fastening opening owing to the forming process, and wherein, for the purpose of mechanical connection, the connecting element, by way of its shaft, protrudes beyond the carrier strip before the plastic forming, and wherein a head section is formed at the protruding end of the shaft owing to the forming process, the dimension of said head section transverse to the shaft axis being larger than the cross section of the fastening opening.

8. The contact element according to claim 1, wherein the shaft is deformed over its entire cross section with respect to the protruding part; or wherein the shaft is selectively deformed at different subregions of its cross section.

9. The contact element according to claim 1, wherein the shaft that protrudes away from the fastening section has, in the undeformed state, a length that corresponds at least to the thickness of the carrier strip and/or that corresponds at most to the thickness, in particular to half the thickness, of the fastening section.

10. The contact element according to claim 1, wherein there are precisely two connecting elements or more than two connecting elements for each contact part.

11. The contact element according to claim 1, wherein the connecting element extends along a shaft axis as seen from the fastening section, and wherein the dimension in a first transverse axis, which lies transverse to the shaft axis, is larger than or equal to the dimension in a second transverse axis that lies transverse to the shaft axis and to the first transverse axis.

12. The contact element according to claim 1, wherein the connecting element extends along a shaft axis as seen from the fastening section, and wherein the dimension in a first transverse axis, which lies transverse to the shaft axis, is larger than or equal to the dimension in a second transverse axis that lies transverse to the shaft axis and to the first transverse axis and wherein the formed shaft is round or polygonal.

13. The contact element according to claim 1, wherein the connecting element extends along a shaft axis as seen from the fastening section, wherein the dimension in a first transverse axis, which lies transverse to the shaft axis, is larger than or equal to the dimension in a second transverse axis that lies transverse to the shaft axis and to the first transverse axis, and wherein the first transverse axis is oriented in a manner angularly inclined at an angle in relation to the longitudinal direction of the carrier strip; or wherein the first transverse axis is at a right angle in relation to the longitudinal axis.

14. The contact element according to claim 1, wherein the connecting element extends along a shaft axis as seen from the fastening section, wherein the dimension in a first transverse axis, which lies transverse to the shaft axis, is larger than the dimension in a second transverse axis that lies transverse to the shaft axis and transverse to the first transverse axis, and wherein the shaft is selectively deformed at various subregions of its cross section.

15. The contact element according to claim 1, wherein the connecting element extends along a shaft axis as seen from the fastening section, wherein the dimension in a first transverse axis, which lies transverse to the shaft axis, is larger than the dimension in a second transverse axis that lies transverse to the shaft axis and transverse to the first transverse axis, wherein the shaft is selectively deformed at various subregions of its cross section, and wherein the shaft is deformed at at least two subregions or exactly two subregions that are situated opposite one another with respect to the second transverse axis.

16. The contact element according to claim 1, wherein the connecting element extends along a shaft axis as seen from the fastening section, wherein the dimension in a first transverse axis, which lies transverse to the shaft axis, is larger than the dimension in a second transverse axis that lies transverse to the shaft axis and transverse to the first transverse axis, and wherein the shaft is selectively deformed at various subregions of its cross section and wherein the formed shaft is round or polygonal.

17. The contact element according to claim 1, wherein the connecting element extends along a shaft axis as seen from the fastening section, wherein the dimension in a first transverse axis, which lies transverse to the shaft axis, is larger than the dimension in a second transverse axis that lies transverse to the shaft axis and transverse to the first transverse axis, wherein the shaft is selectively deformed at various subregions of its cross section, and wherein the first transverse axis is oriented in a manner angularly inclined at an angle in relation to the longitudinal direction of the carrier strip; or wherein the first transverse axis is at a right angle in relation to the longitudinal axis.

18. The contact element according to claim 1, wherein the at least one connecting element has a round cross section or a cross section that complements an elongate hole or an n-gonal cross section or a polygonal cross section; and/or wherein the at least one connecting element has a full cross section or a hollow cross section.

19. A method for producing a contact element as claimed in claim 1, wherein the method comprises the steps of a) providing the carrier strip;

b) providing the contact parts; and c) connecting the contact parts to the carrier strip, and d) plastically deforming the shaft of the at least one connecting element, wherein the step of providing the contact parts comprises forming the connecting element from the contact part or fixedly fastening the connecting element to the contact part.

* * * * *